US012250971B2

(12) United States Patent
Sutton

(10) Patent No.: US 12,250,971 B2
(45) Date of Patent: Mar. 18, 2025

(54) VAPOR PROVISION SYSTEM AND CORRESPONDING METHOD

(71) Applicant: NICOVENTURES TRADING LIMITED, London (GB)

(72) Inventor: Joseph Sutton, London (GB)

(73) Assignee: NICOVENTURES TRADING LIMITED, London (GB)

( * ) Notice: Subject to any disclaimer, the term of this patent is extended or adjusted under 35 U.S.C. 154(b) by 570 days.

(21) Appl. No.: 17/594,344

(22) PCT Filed: Apr. 9, 2020

(86) PCT No.: PCT/GB2020/050922

§ 371 (c)(1),
(2) Date: Oct. 12, 2021

(87) PCT Pub. No.: WO2020/208356

PCT Pub. Date: Oct. 15, 2020

(65) Prior Publication Data

US 2022/0183381 A1 Jun. 16, 2022

(30) Foreign Application Priority Data

Apr. 12, 2019 (GB) ..... 1905251

(51) Int. Cl.
*A24F 40/50* (2020.01)
*A24F 40/10* (2020.01)
*A24F 40/44* (2020.01)

(52) U.S. Cl.
CPC ..... *A24F 40/50* (2020.01); *A24F 40/10* (2020.01); *A24F 40/44* (2020.01)

(58) Field of Classification Search
CPC ..... A24F 40/10; A24F 40/44; A24F 40/50; A24F 40/57
See application file for complete search history.

(56) References Cited

U.S. PATENT DOCUMENTS 6,164,287 A 12/2000 White
2007/0074734 A1 4/2007 Braunshteyn et al.
(Continued)

FOREIGN PATENT DOCUMENTS

CN 204116873 U 1/2015
CN 206237171 U 6/2017
(Continued)

OTHER PUBLICATIONS

International Search Report and Written Opinion PCT/GB2020/050922 date mailed Jul. 6, 2020.
(Continued)

*Primary Examiner* — Abdullah A Riyami
*Assistant Examiner* — Thang H Nguyen
(74) *Attorney, Agent, or Firm* — Husch Blackwell

(57) ABSTRACT

A vapor provision system comprising a heating element for generating vapor from a liquid vapor precursor material and a wick for transporting liquid vapor precursor material from a reservoir to the heating element. The vapor provision system further comprises a user activation mechanism for signaling the user's intent to start vapor generation and configured to be actuated by a user and control circuitry configured to supply a constant average voltage power to the heating element in response to a signal output from the user activation mechanism. The control circuitry is configured to supply the constant average voltage power to the heating element regardless of the temperature of the heating element.

13 Claims, 4 Drawing Sheets

(56) References Cited

U.S. PATENT DOCUMENTS

| | | | | |
|---|---|---|---|---|
| 2014/0270727 | A1* | 9/2014 | Ampolini | A24F 40/50 392/394 |
| 2016/0143359 | A1* | 5/2016 | Xiang | A24F 40/53 392/386 |
| 2017/0181468 | A1 | 6/2017 | Bowen et al. | |
| 2018/0242634 | A1 | 8/2018 | Sur | |
| 2019/0089180 | A1* | 3/2019 | Sur | H02J 7/00047 |
| 2022/0007740 | A1* | 1/2022 | Lin | H01M 10/46 |
| 2024/0306709 | A1* | 9/2024 | Atkins | A24F 40/51 |

FOREIGN PATENT DOCUMENTS

| | | | | |
|---|---|---|---|---|
| CN | 207561379 | U | 7/2018 | |
| GB | 2519101 | | 4/2015 | |
| WO | 2013174001 | A1 | 11/2013 | |
| WO | WO2018134564 | | 7/2018 | |
| WO | WO2018161610 | | 9/2018 | |
| WO | WO2019005526 | | 1/2019 | |
| WO | WO-2019005526 | A1 * | 1/2019 | A24D 1/20 |

OTHER PUBLICATIONS

"International Preliminary Report on Patentability for Application No. PCT/GB2020/050922, mailed on Oct. 21, 2021", 8 pages.

* cited by examiner

VAPOR PROVISION SYSTEM AND CORRESPONDING METHOD

The present application is a National Phase entry of PCT Application No. PCT/GB2020/050922, filed Apr. 9, 2020 which claims priority from GB Patent Application No. 1905251.3 filed Apr. 12, 2019, each of which is hereby fully incorporated herein by reference.

TECHNICAL FIELD

The present disclosure relates to vapor provision systems such as nicotine delivery systems (e.g. electronic cigarettes and the like).

BACKGROUND

Electronic vapor provision systems such as electronic cigarettes (e-cigarettes) generally contain a vapor precursor material, such as a reservoir of a source liquid containing a formulation, typically including nicotine, or a solid material such as a tobacco-based product, from which a vapor is generated for inhalation by a user, for example through heat vaporization. Thus, a vapor provision system will typically comprise a vapor generation chamber containing a vaporizer, e.g. a heating element, arranged to vaporize a portion of precursor material to generate a vapor in the vapor generation chamber. As a user inhales on the device and electrical power is supplied to the vaporizer, air is drawn into the device through inlet holes and into the vapor generation chamber where the air mixes with the vaporized precursor material and forms a condensation aerosol. There is a flow path between the vapor generation chamber and an opening in the mouthpiece so the incoming air drawn through the vapor generation chamber continues along the flow path to the mouthpiece opening, carrying some of the vapor/condensation aerosol with it, and out through the mouthpiece opening for inhalation by the user. Some electronic cigarettes may also include a flavor element in the flow path through the device to impart additional flavors. Such devices may sometimes be referred to as hybrid devices and the flavor element may, for example, include a portion of tobacco arranged in the air path between the vapor generation chamber and the mouthpiece so that vapor/condensation aerosol drawn through the devices passes through the portion of tobacco before exiting the mouthpiece for user inhalation.

Problems can arise with such vapor provision systems if there is no longer sufficient vapor precursor material adjacent the heating element (sometimes known as the vapor provision system running dry). This can happen, for example, because the supply of vapor precursor material to the heating element is running out. In that event, rapid over-heating in and around the heating element can occur. Having regard to typical operating conditions, the overheated sections might be expected to quickly reach temperatures up to 500 to 900° C. Not only does this rapid heating potentially damage components within the vapor provision system itself, it may also adversely affect the vaporization process of any residual precursor material. For example, the excess heat may cause the residual precursor material to decompose, for example through pyrolysis, which can potentially release unpleasant tasting substances into the air stream to be inhaled by a user. Unpleasant tasting substances, or the like, may also be released from over heating other components of the aerosol provision device, such as the wick in some liquid vapor precursor systems.

Various approaches are described which seek to help address some of these issues.

SUMMARY

According to a first aspect of certain embodiments there is provided a vapor provision system comprising: a heating element for generating vapor from a liquid vapor precursor material; a wick for transporting liquid vapor precursor material from a reservoir to the heating element; a user activation mechanism for signaling the user's intent to start vapor generation and configured to be actuated by a user; and control circuitry configured to supply a constant average voltage power to the heating element in response to a signal output from the user activation mechanism, wherein the control circuitry is configured to supply the constant average voltage power to the heating element regardless of the temperature of the heating element.

According to a second aspect of certain embodiments there is provided a control circuitry, for use in a vapor provision system for generating a vapor from a vapor precursor material, the vapor provision system comprising a heating element for generating vapor from a liquid vapor precursor material, a wick for transporting liquid vapor precursor material from a reservoir to the heating element, and a user activation mechanism for signaling the user's intent to start vapor generation and configured to be actuated by a user, wherein the control circuitry is configured to supply a constant average voltage power to the heating element in response to a signal output from the user activation mechanism, and wherein the control circuitry is configured to supply the constant average voltage power to the heating element regardless of the temperature of the heating element.

According to a third aspect of certain embodiments there is provided a vapor provision device comprising the control circuitry of the second aspect.

According to a fourth aspect of certain embodiments there is provided a method of operating control circuitry for a vapor provision system comprising a heating element for generating vapor from a liquid vapor precursor material, a wick for transporting liquid vapor precursor material from a reservoir to the heating element, and a user activation mechanism for signaling the user's intent to start vapor generation and configured to be actuated by a user, wherein the method comprises: supplying, via the control circuitry, a constant average voltage power to the heating element in response to a signal output from the user activation mechanism, wherein the control circuitry is configured to supply the constant average voltage power to the heating element regardless of the temperature of the heating element.

According to a fifth aspect of certain embodiments there is provided a vapor provision system comprising: a heating means for generating vapor from a liquid vapor precursor material; a wicking means for transporting liquid vapor precursor material from a storage means to the heating means; a user activation means for signaling the user's intent to start vapor generation and configured to be actuated by a user; and control means configured to supply a constant average power to the heating means in response to a signal output from the user activation means, wherein the control means is configured to supply the constant average power to the heating means regardless of the temperature of the heating means.

It will be appreciated that features and aspects of the invention described above in relation to the first and other aspects of the invention are equally applicable to, and may be combined with, embodiments of the invention according to other aspects of the invention as appropriate, and not just in the specific combinations described above.

BRIEF DESCRIPTION OF THE DRAWINGS

Embodiments of the invention will now be described, by way of example only, with reference to the accompanying drawings, in which.

DETAILED DESCRIPTION

Figure 1:
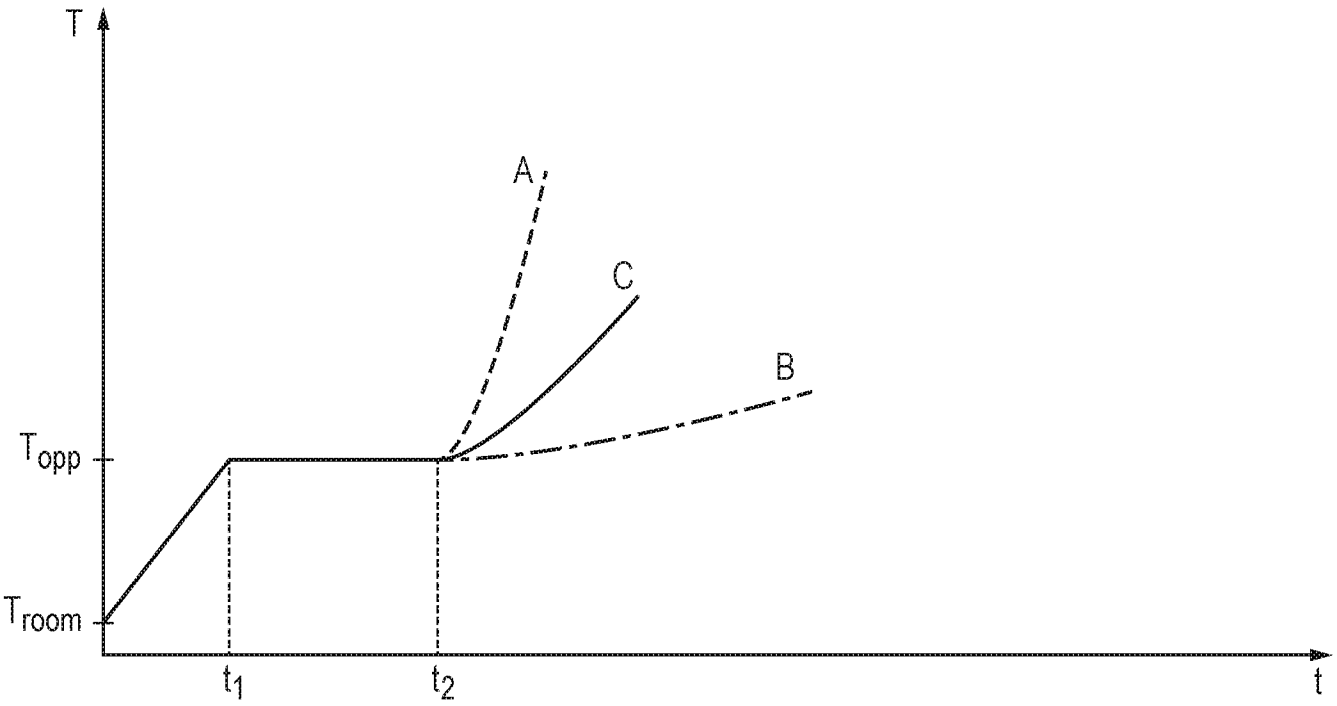
FIG. 1 is a graph representing the temperature characteristics of a heating element under three different conditions.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems, which may also be referred to as aerosol provision systems, such as e-cigarettes, including hybrid devices. Throughout the following description the term "e-cigarette" or "electronic cigarette" may sometimes be used, but it will be appreciated this term may be used interchangeably with vapor provision system/device and electronic vapor provision system/device. Furthermore, and as is common in the technical field, the terms "vapor" and "aerosol", and related terms such as "vaporize", "volatilize" and "aerosolize", may generally be used interchangeably.

Vapor provision systems (e-cigarettes) often, though not always, comprise a modular assembly including both a reusable part and a replaceable (disposable) cartridge part. Often the replaceable cartridge part will comprise the vapor precursor material and the vaporizer and the reusable part will comprise the power supply (e.g. rechargeable battery), activation mechanism (e.g. button or puff sensor), and control circuitry. However, it will be appreciated these different parts may also comprise further elements depending on functionality. For example, for a hybrid device the cartridge part may also comprise the additional flavor element, e.g. a portion of tobacco, provided as an insert ("pod"). In such cases the flavor element insert may itself be removable from the disposable cartridge part so it can be replaced separately from the cartridge, for example to change flavor or because the usable lifetime of the flavor element insert is less than the usable lifetime of the vapor generating components of the cartridge. The reusable device part will often also comprise additional components, such as a user interface for receiving user input and displaying operating status characteristics.

For modular systems a cartridge and reusable device part are electrically and mechanically coupled together for use, for example using a screw thread, latching, friction-fit, or bayonet fixing with appropriately engaging electrical contacts. When the vapor precursor material in a cartridge is exhausted, or the user wishes to switch to a different cartridge having a different vapor precursor material, a cartridge may be removed from the device part and a replacement cartridge attached in its place. Systems conforming to this type of two-part modular configuration may generally be referred to as two-part devices or multi-part devices.

It is relatively common for electronic cigarettes, including multi-part devices, to have a generally elongate shape and, for the sake of providing a concrete example, certain embodiments of the disclosure described herein will be taken to comprise a generally elongate multi-part system employing disposable cartridges containing liquid vapor precursor material. However, it will be appreciated the underlying principles described herein may equally be adopted for different electronic cigarette configurations, for example single-part devices or modular devices comprising more than two parts, refillable devices and single-use disposable devices, and hybrid devices which have an additional flavor element, such as a tobacco pod insert, situated along the air flow path and upstream of the vaporizer, as well as devices conforming to other overall shapes, for example based on so-called box-mod high performance devices that typically have a more box-like shape. More generally, it will be appreciated certain embodiments of the disclosure are based on electronic cigarettes that are configured to provide activation functionality in accordance with the principles described herein, and the specific constructional aspects of electronic cigarette configured to provide the described activation functionality are not of primary significance.

When using an e-cigarette as broadly described above, there are instances when there is no longer a sufficient amount of vapor precursor material (e.g., a liquid) adjacent to the vaporizer (heating element). These situations are sometimes referred to as "dry outs"; that is, the heating element or the vapor precursor transport element becomes dry. In such instances, the heating element may increase in temperature, beyond what would be considered a normal operating temperature. This, generally, can cause other components of the vapor provision system, such as the vapor precursor transport element (wick) to heat up and, potentially char. This can cause unpleasant tastes in the air that is inhaled by the user via the vapor provision system.

Some vapor provision systems aim to counteract such occurrences by measuring the temperature (directly or indirectly) of the heating element, and then mitigating against the temperature increase of the heating element. These systems often require additional components to perform measurements of the parameters associated with the heating element, such as measuring the electrical resistance of the heating element, which can add to the complexity and cost of the vapor provision system.

It has been found, however, that by carefully considering the characteristics of the vapor provision system, such as the power supplied to the heating element, the amount of vapor precursor available at any given moment, etc., a balance can be struck between providing the user with a gradual, increasingly noticeable taste indication that dry out has occurred over, for example, two to three puffs, without causing substantial damage to the heating element or the wick. In other words, instead of providing complex circuitry or specific components to monitor dry out, by carefully considering the parameters of the system, dry out can be observed directly by the user.

In this regard, it is important to clarify that what is significant here is the fact that a controlled drying out of the wick is gradually occurring over a certain number of puffs, based on a careful balance between the e-liquid remaining within the wick and the power supplied to the heating element. For example, if the rate of vaporization (which is a function at least of the power supplied to the heating element and the e-liquid held in the wick) is significantly greater than the rate of replenishment (which is a function at least of the e-liquid remaining in the reservoir and the properties of the wick), then any e-liquid within the wick and close to the heating element will be vaporized quickly and energy will be dissipated into the wicking material more quickly. In other words, the temperature of the heating element will increase from an operational temperature rapidly. This will cause a sudden onset of unpleasant tastes in a given puff, meaning that, for example, quite a strong unpleasant taste will be present in a single puff. While this may give an indication to a user that dry out has occurred, this may be quite unpleasant for a user and, in addition, there is an increased chance that damage to the vapor provision system will occur. Conversely, if the rate of vaporization is only slightly greater than the rate of replenishment, dry out will occur only slightly with each puff. For example, to reach the same level of unpleasant taste in the aerosol as mentioned in the former example, a larger number of puffs, say twenty to thirty, may be required. This may lead to user's getting used to the unpleasant taste generated by during the onset of dry out over the course of these puffs, and hence the user may not be able to readily tell when dry out is occurring. This also increases the risk of damaging the vapor provision system.

FIG. 1 is a graph showing a theoretical plot of temperature (T) along the y-axis versus time (t) along the x-axis, which is presented here as a aid to understanding the principles of the present disclosure. In this theoretical plot, a heating element and wick combination are heated continuously (i.e., this graph does not consider intermittent heating which would be attributed to discrete puffs).

Initially, the heating element is at room temperature (shown on the graph as $T_{room}$). Constant power (voltage) is applied to the electrically heated heating element and this causes an increase in temperature up to an operational temperature ($T_{opp}$) at time $t_1$. At this time, the system reaches an equilibrium, in that the rate of vaporization of the e-liquid within the wick is approximately equal to the rate of replenishment. This continues until a time $t_2$. At time $t_2$, the rate of replenishment starts to decrease due to the fact that the supply of e-liquid to the wick gradually decreases. In other words, e-liquid is not supplied to the wick (and thus to the heating element) as it was previously.

FIG. 1 shows three different scenarios, represented by curves A (dashed line), B (dash-dot line) and C (solid line), corresponding to the scenarios described above. That is, if the rate of vaporization is significantly greater than the rate of replenishment, then any e-liquid within the wick and close to the heating element will be vaporized quickly and energy will be dissipated into the wicking material more quickly. In other words, the temperature of the heating element will increase from an operational temperature rapidly. This is represented by curve A. Conversely, if the rate of vaporization is only slightly greater than the rate of replenishment, dry out will occur only slightly with time. This is represented by curve B. However, curve C provides a sufficient difference between the rate of replenishment and the rate of vaporization, such that the temperature increase is within certain boundaries (that is, the rate of change of temperature with time when the wick starts to deplete (or dry out) is not too great, nor too small). This curve C provides a delicate balance in which off-tastes can be communicated to the user via the aerosol, but in a controlled and gradual manner such that the user can sense that dry out is occurring without exposing the wick and heating element to particularly high temperatures which might otherwise cause damage to the vapor provision system.

In particular, one can define an approximate gradient associated with each of the curves A, B, and C after the onset of dry out by fitting a straight line to these parts of the curves. The gradient effectively gives an indication of a temperature increase per unit time, or in mathematical terms, dT/dt. In accordance with the system described in FIG. 2 (described more fully later), the rate of change of temperature with respect to time once dry out occurs is between 90° C. per second and 10° C. per second, in order to provide a gradual increase in the unpleasant tastes generated by continuing to heat the heating element.

Hence, the present disclosure describes a system in which a constant average level of power is supplied to the heating element during the course of a puff, and for each subsequent puff. The constant average level of power is chosen such that there is a balance between the rate of vaporization and the rate of replenishment, and in particular, in instances where the mass of e-liquid adjacent to the heating element decreases with time. Such a balance provides a gradually detectable taste to the user that the e-liquid is depleting and hence enables the user to take the necessary actions to replace the cartridge part. The average constant power is supplied to the heating element 48 regardless of the temperature of the heating element 48. This is because the level of dry out that the user experiences is gradual enough between puffs to act as an indicator to prompt the user to undertake the necessary actions, such as changing the cartridge part.

Next is described an example e-cigarette 1 (or vapor provision system 1) in more detail.

Figure 2:
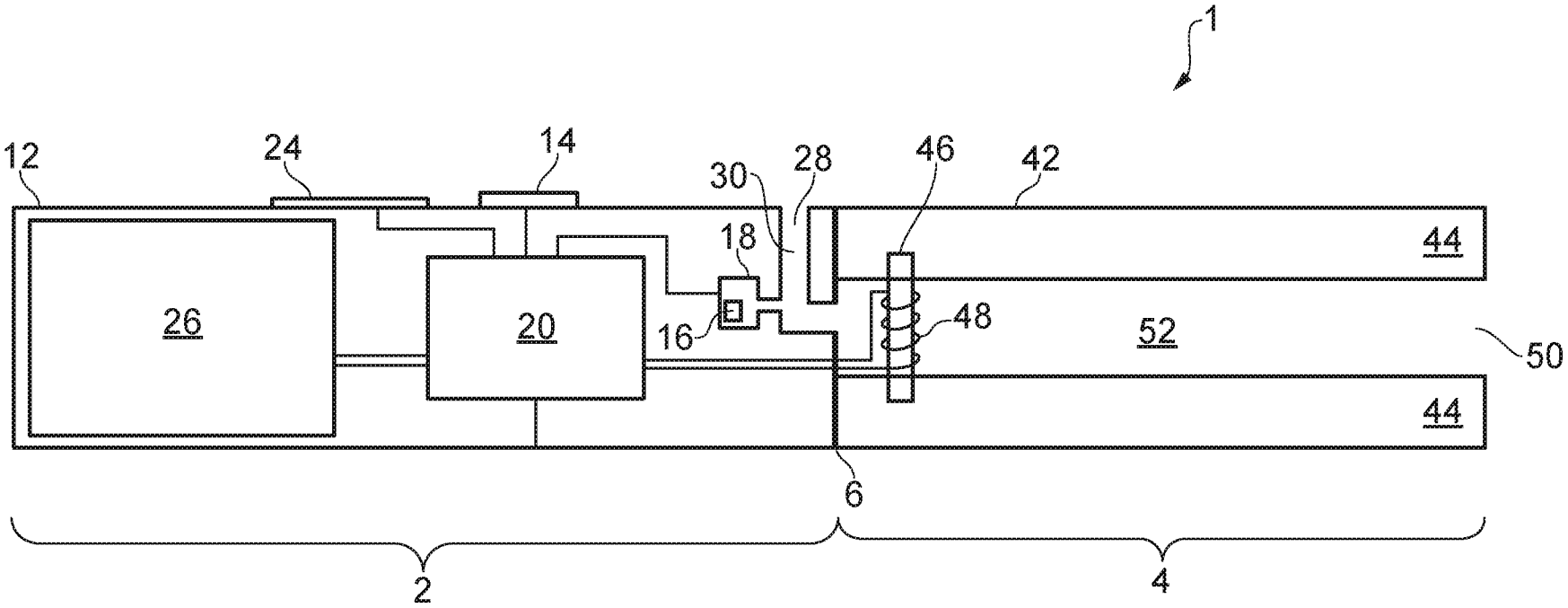
FIG. 2 represents in highly schematic cross-section a vapor provision system in accordance with certain embodiments of the disclosure.

FIG. 2 is a cross-sectional view through an example e-cigarette 1 in accordance with certain embodiments of the disclosure. The e-cigarette 1 comprises two main components, namely a reusable part 2 and a replaceable/disposable cartridge part 4.

In normal use the reusable part 2 and the cartridge part 4 are releasably coupled together at an interface 6. When the cartridge part is exhausted or the user simply wishes to switch to a different cartridge part, the cartridge part may be removed from the reusable part and a replacement cartridge part attached to the reusable part in its place. The interface 6 provides a structural, electrical and air path connection between the two parts and may be established in accordance with conventional techniques, for example based around a screw thread, latch mechanism, or bayonet fixing with appropriately arranged electrical contacts and openings for establishing the electrical connection and air path between the two parts as appropriate. The specific manner by which the cartridge part 4 mechanically mounts to the reusable part 2 is not significant to the principles described herein, but for the sake of a concrete example is assumed here to comprise a latching mechanism, for example with a portion of the cartridge being received in a corresponding receptacle in the reusable part with cooperating latch engaging elements (not represented in FIG. 2). It will also be appreciated the interface 6 in some implementations may not support an electrical connection between the respective parts. For example, in some implementations a vaporizer may be provided in the reusable part rather than in the cartridge part, or alternatively the transfer of electrical power from the reusable part to the cartridge part may be wireless (e.g. based on electromagnetic induction), so that an electrical connection between the reusable part and the cartridge part is not necessary.

The cartridge part 4 may in accordance with certain embodiments of the disclosure be broadly conventional. In FIG. 2, the cartridge part 4 comprises a cartridge housing 42 formed of a plastics material. The cartridge housing 42 supports other components of the cartridge part and provides the mechanical interface 6 with the reusable part 2. The cartridge housing is generally circularly symmetric about a longitudinal axis along which the cartridge part couples to the reusable part 2. In this example the cartridge part has a length of around 4 cm and a diameter of around 1.5 cm. However, it will be appreciated the specific geometry, and more generally the overall shapes and materials used, may be different in different implementations.

Within the cartridge housing 42 is a reservoir 44 that contains liquid vapor precursor material. The liquid vapor precursor material may be conventional, and may be referred to as e-liquid. The liquid reservoir 44 in this example has an annular shape with an outer wall defined by the cartridge housing 42 and an inner wall that defines an air path 52 through the cartridge part 4. The reservoir 44 is closed at each end with end walls to contain the e-liquid. The reservoir 44 may be formed in accordance with conventional techniques, for example it may comprise a plastics material and be integrally molded with the cartridge housing 42.

The cartridge part further comprises a wick (vapor precursor transport element) 46 and a heating element (vaporizer) 48 located towards an end of the reservoir 44 opposite to the mouthpiece outlet 50. In this example the wick 46 extends transversely across the cartridge air path 52 with its ends extending into the reservoir 44 of e-liquid through openings in the inner wall of the reservoir 44. The openings in the inner wall of the reservoir are sized to broadly match the dimensions of the wick 46 to provide a reasonable seal against leakage from the liquid reservoir into the cartridge air path without unduly compressing the wick, which may be detrimental to its fluid transfer performance.

The wick 46 and heating element 48 are arranged in the cartridge air path 52 such that a region of the cartridge air path 52 around the wick 46 and heating element 48 in effect defines a vaporization region for the cartridge part. E-liquid in the reservoir 44 infiltrates the wick 46 through the ends of the wick extending into the reservoir 44 and is drawn along the wick by surface tension/capillary action (i.e. wicking). The heating element 48 in this example comprises an electrically resistive wire coiled around the wick 46. The heating element 48 may be formed from any suitable metal or electrically conductive material which exhibits a change in resistance with temperature. In this example the heating element 48 comprises a nickel iron alloy (e.g. NF60) wire and the wick 46 comprises a cotton fibre bundle.

In one example, the heating element 48 comprises a nickel iron alloy wire having a thickness (of the wire) of between 0.17 mm to 0.20 mm (e.g., 0.188 mm±0.02 mm) and a length of between 55 mm to 65 mm (e.g., 60.0 mm±2.5 mm). The wire is formed into a helical coil having an axial length of between 4.0 to 6.0 mm (e.g., 5.00 mm±0.5 mm), and having an outer diameter of between 2.2 mm to 2.7 mm (e.g., 2.50 mm±0.2 mm). The coil in this example is formed to have 9 turns, and has a turn pitch of 0.67±0.2 per mm. The resistance of the coil, in a non-powered state and measured at room temperature (e.g., 25°) is between 1.1 to 1.6 Ohms, more specifically 1.4 Ohms±0.1 Ohms. As described in more detail below, the power supplied to the heating element 48 is set to be between 6.0 and 6.5 Watts. The wick 46 in the example described is formed of an organic cotton (although alternative implementations may use a glass fiber bundle). The wick is formed into an approximately cylindrical structure having a length of between 15 mm to 25 mm (e.g., 20.00±2.0 mm), having a diameter of between 2 to 5 mm (e.g., 3.5 mm+1.0 mm/−0.5 mm). The organic cotton fibers are twisted together at 40±5 twist/m. Such an arrangement provides for an e-liquid absorption of between 0.2 g to 0.5 g (e.g., 0.3 g±0.05 g) and an absorbing time of 65 s±10 s. Note that during formation, the wick 46 is partially located in the inner volume defined by the helical coil.

In another example, the heating element 48 comprises a nickel iron alloy wire having a thickness (of the wire) of between 0.14 mm to 0.18 mm (e.g., 0.16 mm±0.02 mm) and a length of between 37 mm to 47 mm (e.g., 43.0 mm±2.5 mm). The wire is formed into a helical coil having an axial length of between 3.0 to 5.0 mm (e.g., 4.00 mm±0.5 mm), and having an outer diameter of between 2.2 mm to 2.7 mm (e.g., 2.50 mm±0.2 mm). The coil in this example is formed to have 7 turns, and has a turn pitch of 0.67±0.2 per mm. The resistance of the coil, in a non-powered state and measured at room temperature (e.g., 25°) is between 1.1 to 1.6 Ohms, more specifically 1.4 Ohms±0.1 Ohms. As above, the power supplied to the heating element 48 is set to be between 6.0 and 6.5 Watts. The wick 46 in the example described is also formed of an organic cotton (although alternative implementations may use a glass fiber bundle). The wick is formed into an approximately cylindrical structure having a length of between 12 mm to 18 mm (e.g., 15.00±2.0 mm), having a diameter of between 2 to 5 mm (e.g., 3.5 mm+1.0 mm/−0.5 mm). The organic cotton fibers are twisted together at 40±5 twist/m. Such an arrangement provides for an e-liquid absorption of between 0.2 g to 0.5 g (e.g., 0.3 g±0.05 g) and an absorbing time of 65 s±10 s. As above, the wick 46 is partially located in the inner volume defined by the helical coil.

However, it will be appreciated the specific vaporizer configuration is not significant to the principles described herein, and the above limitations are provided by way of a concrete example.

In use electrical power may be supplied to the heating element 48 to vaporize an amount of e-liquid (vapor precursor material) drawn to the vicinity of the heating element 48 by the wick 46. Vaporized e-liquid may then become entrained in air drawn along the cartridge air path from the vaporization region through the cartridge air path 52 and out the mouthpiece outlet 50 for user inhalation.

Broadly, the rate at which e-liquid is vaporized by the vaporizer (heating element) 48 during normal use will depend on the amount (level) of power supplied to the heating element 48 during use. Thus electrical power can be applied to the heating element 48 to selectively generate vapor from the e-liquid in the cartridge part 4, and furthermore, the rate of vapor generation can be altered by altering the amount of power supplied to the heating element 48, for example through pulse width and/or frequency modulation techniques. However, as discussed in greater detail below, one factor that can influence the rate and/or amount of vaporization is the quantity of vapor precursor material in the vicinity of the heating element 48.

The reusable part 2 comprises an outer housing 12 with an opening that defines an air inlet 28 for the e-cigarette, a battery 26 for providing operating power for the electronic cigarette, control circuitry 20 for controlling and monitoring the operation of the electronic cigarette, a user input button 14, an inhalation sensor (puff detector) 16, which in this example comprises a pressure sensor located in a pressure sensor chamber 18, and a visual display 24.

The outer housing 12 may be formed, for example, from a plastics or metallic material and in this example has a circular cross-section generally conforming to the shape and size of the cartridge part 4 so as to provide a smooth transition between the two parts at the interface 6. In this example, the reusable part has a length of around 8 cm so the overall length of the e-cigarette when the cartridge part and reusable part are coupled together is around 12 cm. However, and as already noted, it will be appreciated that the overall shape and scale of an electronic cigarette implementing an embodiment of the disclosure is not significant to the principles described herein.

The air inlet 28 connects to an air path 30 through the reusable part 2. The reusable part air path 30 in turn connects to the cartridge air path 52 across the interface 6 when the reusable part 2 and cartridge part 4 are connected together. The pressure sensor chamber 18 containing the pressure sensor 16 is in fluid communication with the air path 30 in the reusable part 2 (i.e. the pressure sensor chamber 18 branches off from the air path 30 in the reusable part 2). Thus, when a user inhales on the mouthpiece opening 50, there is a drop in pressure in the pressure sensor chamber 18 that may be detected by the pressure sensor 16 and also air is drawn in through the air inlet 28, along the reusable part air path 30, across the interface 6, through the vapor generation region in the vicinity of the atomizer 48 (where vaporized e-liquid becomes entrained in the air flow when the vaporizer is active), along the cartridge air path 52, and out through the mouthpiece opening 50 for user inhalation.

The battery 26 in this example is rechargeable and may be of a conventional type, for example of the kind normally used in electronic cigarettes and other applications requiring provision of relatively high currents over relatively short periods. The battery 26 may be recharged through a charging connector in the reusable part housing 12, for example a USB connector.

The user input button 14 in this example is a conventional mechanical button, for example comprising a spring mounted component which may be pressed by a user to establish an electrical contact. In this regard, the input button may be considered to provide a manual input mechanism for the terminal device, but the specific manner in which the button is implemented is not significant. For example, different forms of mechanical button or touch-sensitive button (e.g. based on capacitive or optical sensing techniques) may be used in other implementations. The specific manner in which the button is implemented may, for example, be selected having regard to a desired aesthetic appearance.

The display 24 is provided to give a user a visual indication of various characteristics associated with the electronic cigarette, for example current power setting information, remaining battery power, and so forth. The display may be implemented in various ways. In this example the display 24 comprises a conventional pixilated LCD screen that may be driven to display the desired information in accordance with conventional techniques. In other implementations the display may comprise one or more discrete indicators, for example LEDs, that are arranged to display the desired information, for example through particular colors and/or flash sequences. More generally, the manner in which the display is provided and information is displayed to a user using the display is not significant to the principles described herein. Some embodiments may not include a visual display and may include other means for providing a user with information relating to operating characteristics of the electronic cigarette, for example using audio signaling or haptic feedback, or may not include any means for providing a user with information relating to operating characteristics of the electronic cigarette.

The control circuitry 20 is suitably configured/programmed to control the operation of the electronic cigarette to provide functionality in accordance with embodiments of the disclosure as described further herein, as well as for providing conventional operating functions of the electronic cigarette in line with the established techniques for controlling such devices. The control circuitry (processor circuitry) 20 may be considered to logically comprise various sub-units/circuitry elements associated with different aspects of the electronic cigarette's operation in accordance with the principles described herein and other conventional operating aspects of electronic cigarettes, such as display driving circuitry and user input detection. It will be appreciated the functionality of the control circuitry 20 can be provided in various different ways, for example using one or more suitably programmed programmable computer(s) and/or one or more suitably configured application-specific integrated circuit(s)/circuitry/chip(s)/chipset(s) configured to provide the desired functionality.

The vapor provision system 1 of FIG. 2 is shown comprising a user input button 14 and an inhalation sensor 16. In the described implementation of FIG. 2, the control circuitry 20 is configured to receive signaling from the inhalation sensor 16 and to use this signaling to determine if a user is inhaling on the electronic cigarette and also to receive signaling from the input button 14 and to use this signaling to determine if a user is pressing (i.e. activating) the input button. These aspects of the operation of the electronic cigarette (i.e. puff detection and button press detection) may in themselves be performed in accordance with established techniques (for example using conventional inhalation sensor and inhalation sensor signal processing techniques and using conventional input button and input button signal processing techniques). The control circuitry 20 is configured to supply power to the heating element 48 if the control circuitry 20 determines that a user is inhaling on the electronic cigarette and/or that the user is pressing the input button 14. However, in other implementations, it should be appreciated that only one of the puff sensor 16 or user input button 14 is provided for the purposes of causing vaporization of the e-liquid.

In accordance with the principles of the present disclosure, the control circuitry 20 is configured to supply a constant average power to the heating element 48 each time the user activates the vapor provision system, e.g., each time the control circuitry 20 determines that a user is inhaling on the electronic cigarette and/or that the user is pressing the input button 14. The control circuitry 20 may supply power for either a predetermined time period starting from the point when the control circuitry 20 determines that a user is inhaling on the electronic cigarette and/or that the user is pressing the input button 14, or constantly in conjunction with the duration of the signaling from the inhalation sensor 16 and/or button 14. The constant average power is supplied in correspondence with the above activation mechanisms, regardless of the temperature of the heating element 48.

It has been found that for an example system 1 such as that described above in which the heating element is a nickel iron alloy wire a resistance of between 1.3 to 1.5 Ohms as measured at room temperature (e.g., 25° C.) and turn pitch of 0.67±0.2 per mm, and the wick is an organic cotton wick having a liquid absorption of between 0.3 g±0.05 g and an absorbing time of 65 s±10 s (as described in the above examples, a suitable power level for such a system is between 6 to 7 Watts, and in some implementations, between 6.0 to 6.5 Watts. As described above, such an average power level is found to have a suitable response in the event that the wick 46 starts to deplete (i.e., the amount of e-liquid held within the wick 46 drops to below a normal operational level). Such a power level provides a gradual indication to the user over two to three puffs (defined, for example, according to a 55 ml puff volume and a 3 second puff duration), which provides a suitably noticeable, yet not too harsh, taste change to a user.

In normal use, i.e., when the wick 46 is fully saturated, the above described examples provide of system 1 generate around 8 mg of vapor per puff (defined according to a predetermined puff volume of 55 ml and a 3 second puff duration). Accordingly, for these systems, one can define a rate of vaporization, for an air flow rate of 18 ml/s, of 2.66 mg/s. Additionally, one can define a rate of replenishment of e-liquid of around 4.6 mg/s±0.9. As described with reference to FIG. 1, when the rate of replenishment becomes less than the rate of vaporization, a dry out condition can occur. As mentioned, this difference should not be too great or too small in accordance with the principles of the present disclosure. For example, the ratio of the rate of vaporization to the rate of replenishment, at the onset of dry out, may be in the range of 4:1 to 1.5:1.

It should be appreciated that a power of 6 to 7 Watts is selected, and provides the appropriate effect, for the above described combination of heating element 48 and wick 46. In other implementations employing different heating elements 48 and different wicks (e.g., of different size, different materials, etc.), different average power levels may be required. These power levels can be determined empirically, for example.

The vapor provision system 1 of FIG. 2, importantly, does not comprise any hardware and/or software components which enable the vapor provision system itself to detect whether dry out is occurring. For example, the vapor provision system 1 comprises no mechanism (either in hardware and/or software) which causes the control circuitry 20 to be able to determine the temperature (and/or the resistance) of the heating element 48. In the case of hardware, this may reduce the cost and complexity of assembling the vapor provision system 1. In the context of software, the power requirements on the control circuitry 20 (i.e., a (micro)controller thereof) can be reduced as the control circuitry 20 need not have to monitor and/or determine a parameter indicative of dry out, nor determine when dry out is occurring. Broadly speaking, the vapor provision system 1 according to the present disclosure is much simpler in terms of hardware and software over systems which employ an active dry out detection mechanism.

It should be appreciated that, in some instances, pre-existing vapor provision systems 1 may be modified (i.e., retrofit) to prevent use of the hardware mechanisms enabling a determination of when dry out is occurring by the control circuitry 20, e.g., for the purposes of reducing power or releasing processing resources. For example, one mechanism that may be employed to detect dry out is by measuring the resistance of the heating element 48 (where resistance is proportional to the temperature of the heating element 48).

Figure 3:
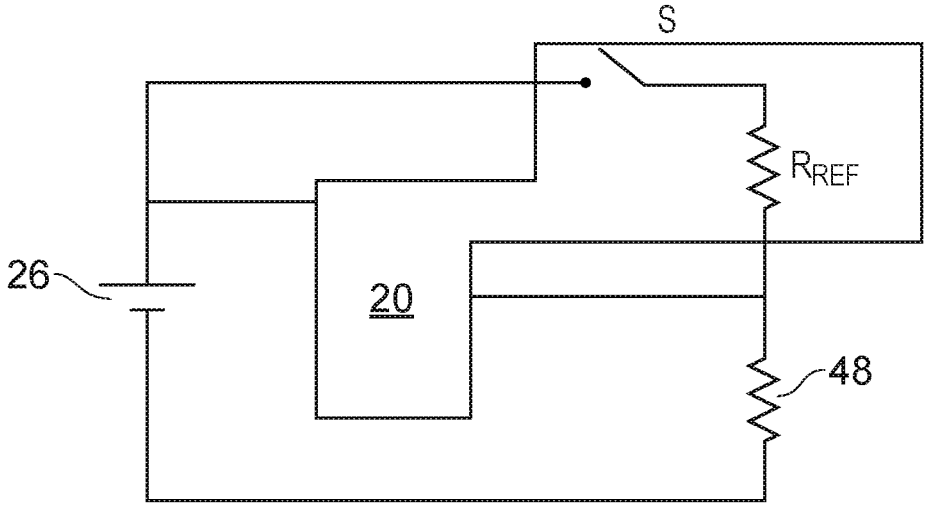
FIG. 3 is a highly schematic circuit diagram of a portion of circuitry employed which may be employed in a vapor provision system and which can be repurposed in accordance with the present disclosure.

FIG. 3 shows a schematic electrical circuit detailing one example implementation of control circuitry 20 comprising a resistance-measuring component and configured to use established techniques for measuring resistance (or a corresponding electrical parameter). It should be appreciated that FIG. 3 is highly schematic and other electrical components are not shown for the purposes of clarity.

In particular, in FIG. 3, the control circuitry 20 comprises a reference resistor, $R_{REF}$, of a known resistance value, connected in series with the heating element 48 (note, the reference resistor may be provided in the device part 2 rather than cartridge part 4). The control circuitry 20 comprises a switching arrangement S. The switching arrangement S may include one or more FETs for example. The switching arrangement S, prior to the circuitry 20 being modified in accordance with the present disclosure, acts to selectively couple the reference resistor $R_{REF}$ to ground (or the negative terminal of battery 26). A signal line is coupled between the reference resistor $R_{REF}$ and the heating element 48 and feeds into a voltage measuring component of the control circuitry 20. When the reference resistor $R_{REF}$ is coupled to the heating element 48, the voltage along the signal line is indicative of the voltage over the heating element 48. In this way, prior to modification according to the present disclosure, potential divider equations can be used by the control circuitry 20 to infer the resistance of the heating element 48, based on the known resistance of the reference resistor $R_{REF}$ and the input voltage to the heating element 48.

However, in accordance with the principles of the present disclosure, the software within the relevant parts of the control circuitry 20 can be modified such that the control circuitry 20 is prevented from activating switch S. As a result, the control circuitry 20 is prevented from being able to determines whether dry out occurs based on a resistance value of the heating element 48. As mentioned, this helps reduce power consumption and may also release some processing resources which may subsequently be allocated to other functionalities of the vapor provision system 1.

Figure 4:
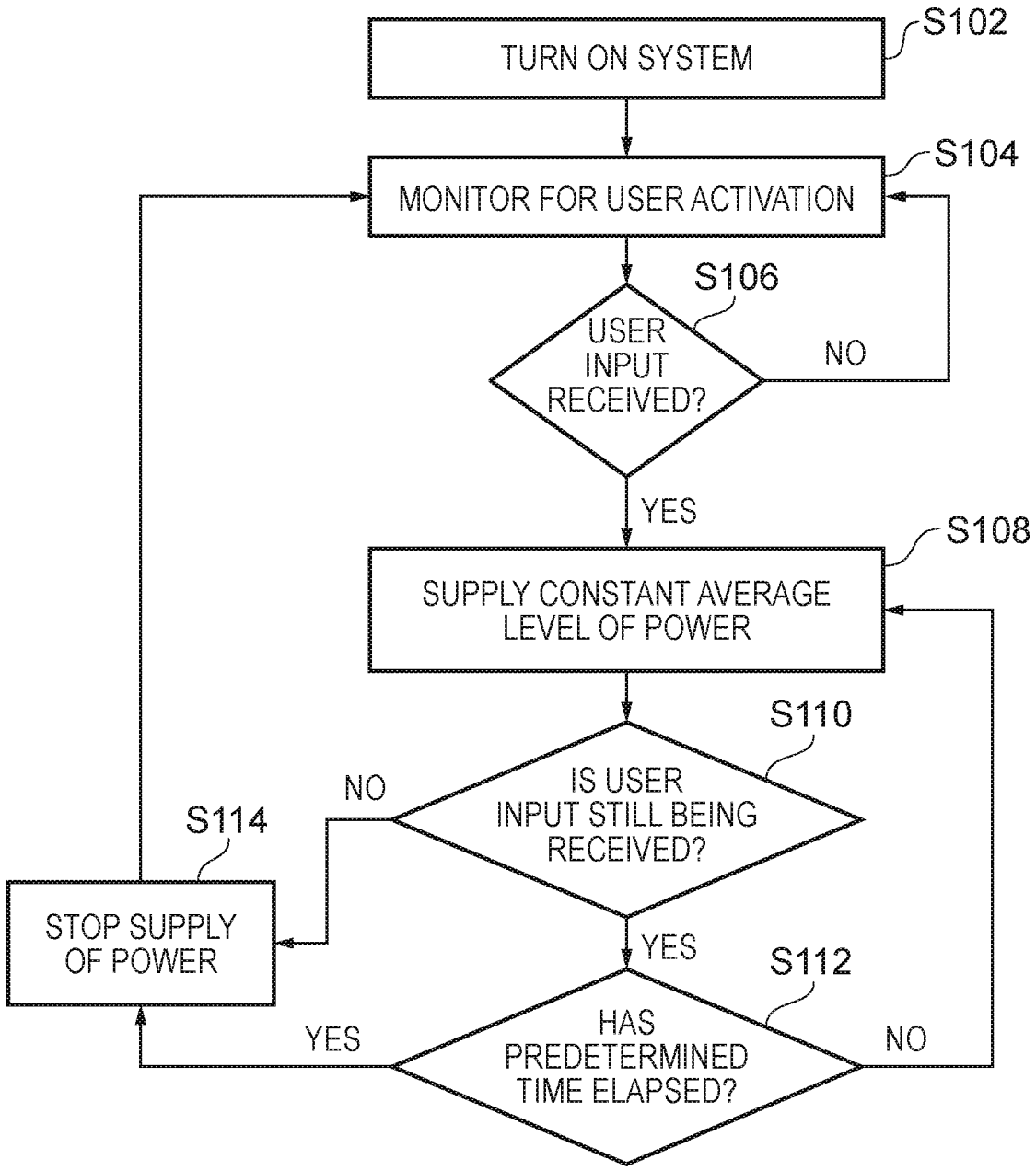
FIG. 4 is a flow diagram representing operating steps for the vapor provision system of FIG. 2 in accordance with an implementation of the disclosure.

FIG. 4 describes a method of operating such a vapor provision system 1, in accordance with aspects of the present disclosure.

FIG. 4 starts at step S102 where a user turns on the vapor provision system 1. The vapor provision system 1 may be turned on in response to a user input. In the implementation of FIG. 2, this is performed by a user actuating the user input button 14. In the example vapor provision system 1 of FIG. 2, to turn on the system 1, the user input button 14 is actuated by the user in accordance with a predefined sequence, e.g., three button presses in quick succession (for example, within 2 seconds). Having a predefined turn on sequence is advantageous when the user input button 14 is used for performing multiple functions, as is the case for the vapor provision system 1 shown in FIG. 2 (and as described below). The same sequence (or an alternative sequence) may also be used to turn off the vapor provision system 1. It should be appreciated that in other implementations a dedicated mechanism turn on/turn off button (or other user input mechanism) may alternatively be employed.

It should be appreciated that the vapor provision system 1 may be in a low power state prior to step S102, such that the control circuitry 20 (or specific parts thereof) are supplied with a low (minimum) level of power in order to perform certain functions, such as monitoring when a user turns on the system 1 using input button 14. In other implementations, the user may turn on the system 1 by physically moving a button (not shown), such as slider button, to complete an electric circuit within control circuitry 20, or between control circuitry 20 and battery 26, thereby causing power to flow to the control circuitry.

Once the system 1 is turned on at step S102, the control circuitry 20 is configured to monitor for a user input (for generating or delivering aerosol to the user) at step S104. As mentioned above, in the described implementation of FIG. 2, the control circuitry 20 is configured to receive signaling from the inhalation sensor 16 and to use this signaling to determine if a user is inhaling on the vapor provision system 1 and/or to receive signaling from the input button 14 and to use this signaling to determine if a user is pressing (i.e. activating) the input button 14. In the described implementation, the control circuitry 20 is configured to repeatedly determine whether or not a user input is received. For example, the control circuitry 20 may be configured to check periodically, e.g., every 0.5 seconds, to determine whether either (or both) of the input button 14 or inhalation sensor 16 is outputting signaling indicative of a user actuation. In alternative implementations, the signaling output from the input button and/or inhalation sensor 16 may trigger an action within the control circuitry 20, for example charging a capacitor or as an input to a comparator or the like. That is, the control circuitry 20 may instead be responsive to the signaling and perform an action in response to receiving the signaling. It should be appreciate that either approach (that is, active monitoring or passive reception of signaling) may be implemented in accordance with the principles of the present disclosure.

In FIG. 4, if the control circuitry 20 determines that either the inhalation sensor 16 or the input button 14 is outputting signaling indicative of actuation, the control circuitry 20 determines that a user input indicative of the user's intent to receive aerosol has been received. That is, YES at step S106. Conversely, if the control circuitry 20 determines that no user input indicative of the user's intent to receive aerosol has been received, the method proceeds back to step S104 and the control circuitry 20 continues to monitor for the user input indicative of the user's intent to receive aerosol.

In response to determining that a user input has been received at step S106, the control circuitry 20 is configured to supply the constant average level of power to the heating element 48 at step S108.

The constant average level of power is supplied to the heating element 48, which initially causes the temperature of the heating element 48 to gradually increase up to an operational temperature at which at least a part of the e-liquid held within the wick 46 is vaporized. In general, the amount of power supplied will vary from implementation to implementation, and is likely to vary in accordance with a number of different factors including, but not limited to, the volume of liquid held within the wick, the relative surface area between the heating element and the e-liquid, and the voltage and current characteristics of the heating element. In normal use, i.e., when the wick 46 is not depleted, there is a balance between the power dissipated by the heating element 48 and used to vaporize the e-liquid, and the mass of e-liquid that is to be heated. Because liquid has a phase transition from liquid to, in this case, vapor, energy that is dissipated into the liquid vaporizes the liquid and, broadly speaking, does not further increase the temperature of the liquid. However, there are other factors to take account of, such that only a percentage of the mass of e-liquid is likely to be vaporized, and the remaining e-liquid held in the wick 46 is heated but is not vaporized. This remaining mass acts as a heat sink and absorbs some of the dissipated energy from the heating element 48. In the example vapor provision system 1, a balance is struck between the power supplied to the heating element 48 and the mass of e-liquid held in the wick 46 so as to generate sufficient aerosol without substantially increasing the temperature of the heating element 48. That is, when the e-liquid in the wick 46 is sufficiently replenished, the temperature of the heating element will, within a certain tolerance, be approximately constant during normal use (and after an initial warm-up period).

As mentioned above, however, when the e-liquid starts to deplete, i.e., drop from a normal operation level, within the wick 46 the temperature of the heating element 48 starts to increase. This changes the distribution of energy from the heating element 48 such that a larger proportion of the energy passes to the remaining e-liquid and to the wick 46. This generally causes an increase in the temperature of the heating element 48 which in turn causes an increase in the temperature of the remaining e-liquid and of the wick 46. This causes a slight unpleasant taste to be generated in the aerosol, e.g., from the e-liquid overheating slightly, as described above, which the user is able to detect.

The control circuitry 20 may be configured to deliver power to the heating element 48 according to any suitable technique. In some implementations, the control circuitry 20 is configured, when determining there is a user input at step S106, to supply DC power continuously (constantly), from the power source 26 to the heating element 48, possibly via any components such as a DC to DC boost converter to adjust the electrical characteristics (e.g., voltage) of the supplied power if necessary. In other implementations, a modulation technique, such as pulse width modulation, PWM, may be used. In these implementations, pulses of power are supplied to the heating element 48. PWM supplies pulses in accordance with a certain duty cycle which, broadly speaking, is the ratio between the pulse width and the period of the signal waveform. In these implementations, the constant average power supplied in step S108 may be considered to be the average power supplied over one duty cycle (i.e., the power provided by the pulse multiplied by the quotient of the duration of the pulse over the duration of the duty cycle). In systems that employ PWM, the constant average power is defined based on the RMS voltage.

As shown in FIG. 4, when the control circuitry 20 supplies the first level of power at step S108, the control circuitry 20 is also configured, at step S110, to determine whether or not there is still a user input indicative of the user's intent to generate aerosol. In normal use, the user will inhale on the system 1 or press the input button 14 for as long as they want to receive aerosol, which is usually around 3 seconds. In other words, in this implementation, the user controls the start and stop of aerosol generation. The control circuitry 20 determines whether or not signaling from the input button 14 or the inhalation sensor 16 indicating activation of one or both of the input button 14 or the inhalation sensor 16 is being received. If it is, i.e., YES at step S110, the method proceeds to step S112.

At step S112, the control circuitry 20 is configured to determine whether a predetermined time from the initial detection of the signaling from the inhalation sensor 16 and/or the input button 14 has elapsed. The predetermined time may be set to 8 or 10 seconds, for example. Because the user is able to dictate how long the heating element 48 is supplied with power (i.e., in correspondence with the actuation of the inhalation sensor 16 and/or button 14), the predetermined timer is inserted to prevent abuse of the system (i.e., to prevent the user from generating significant quantities of aerosol in one activation). In addition, this may act as a safety feature should, for example, the button 14 be inadvertently pressed, e.g., when the system 1 is stored in a user's bag.

If the predetermined time has not elapsed (i.e., NO at step S112), the method proceeds back to step S108 and the control circuitry 20 continues to supply the constant average power to the heating element 48. As specified above, the control circuitry 20 is configured to continuously deliver the constant average power to the heating element 48 regardless of the temperature (and hence resistance) of the heating element 48. In the present implementation, the control circuitry 20 supplies the constant average power primarily in accordance with the user input signal. That is, the supply of power is started and stopped in accordance with the signaling received from the inhalation sensor 16 and/or the button 14, with the exception in this instance that the power is stopped if the signaling persists for more than a predetermined time.

If the control circuitry 20 determines at step S110 that a user input is no longer being received (i.e., NO at step S110) or that the predetermined time since the user input has been received has elapsed (i.e., YES at step S112), then the method proceeds to step S114. When the user input is no longer being received, this indicates that the user has stopped inhaling on system 1 or has stopped pushing the input button 14, and thus no longer wishes to receive aerosol. That is to say, the user has finished that puff/inhalation. At step S114, the supply of power to the heating element 48 is stopped by the control circuitry 20. The method proceeds back to step S104, and the control circuitry 20 monitors for the next user input, signifying the user's desire to receive aerosol.

As described, the present disclosure provides for a vapor provision system 1 in which a constant average power is supplied to the heating element 48 regardless of the temperature of the heating element 48. While dry out may occur, due to a balance between the power supplied and the rate at which the e-liquid is replenished, unpleasant tastes in the aerosol cause, e.g., by the e-liquid overheating, are gradually provided to the user over a period of relatively few puffs (e.g., 2 to 4 puffs). This enables a simpler, less complex, and cheaper vapor provision system to be provided that still provides noticeable indications to a user when dry out is occurring.

Although it has been described above that the control circuitry 20 determines whether a user input is still being received or not (at step S110), this step may be omitted. For example, in some implementations, when the control circuitry 20 determines that a user input has been received at step S106, power is configured to be supplied to the heating element for a predetermined time period from the detection of a user input. For example, power may be supplied for a time period that is approximately equal to a typical puff duration, e.g., three seconds. After the predetermined time period has expired, the power supply to the heating element 48 may be stopped. Broadly speaking, the method of FIG. 4 may be modified to remove step S110 and to set the predetermined time in step S112 to that of a typical puff duration.

Although it has been described above that the vapor provision system 1 comprises a sealed cartridge part 4, it should be appreciated that the cartridge part 4 may be re-fillable in some implementations. The principles of the present disclosure apply equally to such implementations. In yet further implementations, the cartridge part 4 may be an integral part of the reusable device part 2, e.g., formed as one component or at the very least sharing aspects of the housing. The integrated cartridge part 4 is re-fillable with e-liquid. Such arrangements of vapor provision systems may be known as open systems. The principles of the present disclosure apply equally to such implementations.

While the above-described embodiments have in some respects focused on some specific example vapor provision systems, it will be appreciated the same principles can be applied for vapor provision systems using other technologies. That is to say, the specific manner in which various aspects of the vapor provision system function are not directly relevant to the principles underlying the examples described herein.

For example, whereas the above-described embodiments have primarily focused on devices having an electrical heater based vaporizer for heating a liquid vapor precursor material, the same principles may be adopted in accordance with vaporizers based on other technologies, for example piezoelectric vibrator based vaporizers or optical heating vaporizers, and also devices based on other vapor precursor materials, for example solid materials, such as plant derived materials, such as tobacco derivative materials, or other forms of vapor precursor materials, such as gel, paste or foam based vapor precursor materials.

Furthermore, and as already noted, it will be appreciated the above-described approaches in connection with an electronic cigarette may be implemented in cigarettes having a different overall construction than that represented in FIG. 2. For example, the same principles may be adopted in an electronic cigarette which does not comprise a two-part modular construction, but which instead comprises a single-part device, for example a disposable (i.e. non-rechargeable and non-refillable) device. Furthermore, in some implementations of a modular device, the arrangement of components may be different. For example, in some implementations the control unit may also comprise the vaporizer with a replaceable cartridge providing a source of vapor precursor material for the vaporizer to use to generate vapor. Furthermore still, whereas in the above-described examples the electronic cigarette 1 does not include a flavor insert, other example implementations may include such an additional flavor element.

Equally, while the above systems have been described in respect of liquid vapor precursor materials, similar principles can be applied to vapor precursor materials of a different state of matter. For instance, some solids, such as recon tobacco may exhibit characteristic changes in their thermal properties as the material is vaporized. In the event such materials do, then the techniques of the present disclosure may equally be applied to these materials.

Thus there has been described a vapor provision system comprising a heating element for generating vapor from a liquid vapor precursor material; a wick for transporting liquid vapor precursor material from a reservoir to the heating element; a user activation mechanism for signaling the user's intent to start vapor generation and configured to be actuated by a user; and control circuitry configured to supply a constant average voltage power to the heating element in response to a signal output from the user activation mechanism, wherein the control circuitry is configured to supply the constant average voltage power to the heating element regardless of the temperature of the heating element.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention (s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. A vapor provision system comprising:

a heating element for generating vapor from a liquid vapor precursor material;

a wick for transporting liquid vapor precursor material from a reservoir to the heating element;

a user activation mechanism for signaling the user's intent to start vapor generation and configured to be actuated by a user; and control circuitry configured to supply a constant average power to the heating element in response to a signal output from the user activation mechanism;

wherein the control circuitry is configured to supply the constant average power to the heating element regardless of the temperature of the heating element;

wherein the constant average power is set such that the rise in temperature after the onset of dryout, from an operational temperature at which vapor is generated, does not exceed 90° C. per second; and wherein the constant average power is set such that the rise in temperature after the onset of dryout, from an operational temperature at which vapor is generated, does not fall below 10° C. per second, such that the rise in temperature after the onset of dryout provides a gradually detectable taste to a user to act as an indicator to prompt the user to undertake an action corresponding to depletion of the wick of liquid vapor precursor material.

2. The vapor provision system of claim 1, wherein the control circuitry is configured to supply the constant average power for the duration that the user actuates the user activation mechanism.

3. The vapor provision system of claim 1, wherein the heating element is a nickel iron wire having a resistance of between 1.3 Ohm and 1.5 Ohm at 25° C., and the wick comprises cotton.

4. The vapor provision system of claim 3, wherein the constant average power is set such that the power supplied to the heating element is between 6 to 7 Watts.

5. The vapor provision system of claim 1, wherein the vapor provision system comprises no mechanism to determine the temperature of the heating element.

6. The vapor provision system of claim 1, wherein the control circuitry is configured, in software, to not determine the temperature of the heating element.

7. The vapor provision system of claim 1, wherein the circuitry comprises a reference resistor, the reference resistor coupled in series with the heating element, and wherein the reference resistor is able to be coupled to ground or the negative terminal of a power source via closing of a switch, and wherein the control circuitry is configured to keep the switch open at all times.

8. The vapor provision system of claim 1, wherein the control circuitry is configured to monitor the length of time the user input mechanism is actuated for by a user, and when the control circuitry detects that the user input mechanism is actuated by a user for longer than a predetermined time period, the control circuitry is configured to stop power being supplied to the heating element.

9. The vapor provision system of claim 1, wherein the vapor provision system comprises a cartridge part and a device part configured to be releasably coupled together, wherein the cartridge part comprises the heating element and the wick, and wherein the device part comprises the user activation mechanism and the control circuitry.

10. A control circuitry, for use in a vapor provision system for generating a vapor from a vapor precursor material, the vapor provision system comprising a heating element for generating vapor from a liquid vapor precursor material, a wick for transporting liquid vapor precursor material from a reservoir to the heating element, and a user activation mechanism for signaling the user's intent to start vapor generation and configured to be actuated by a user, the control circuitry comprising:

processor circuitry, wherein the control circuitry is configured to supply a constant average power to the heating element in response to a signal output from the user activation mechanism, and wherein the control circuitry is configured to supply the constant average power to the heating element regardless of the temperature of the heating element;

wherein the constant average power is set such that the rise in temperature after the onset of dryout, from an operational temperature at which vapor is generated, does not exceed 90° C. per second; and wherein the constant average power is set such that the rise in temperature after the onset of dryout, from an operational temperature at which vapor is generated, does not fall below 10° C. per second, such that the rise in temperature after the onset of dryout provides a gradually detectable taste to a user to act as an indicator to prompt the user to undertake an action corresponding to depletion of the wick of liquid vapor precursor material.

11. A vapor provision device comprising the control circuitry of claim 10.

12. A method of operating control circuitry for a vapor provision system comprising a heating element for generating vapor from a liquid vapor precursor material, a wick for transporting liquid vapor precursor material from a reservoir to the heating element, and a user activation mechanism for signaling the user's intent to start vapor generation and configured to be actuated by a user, wherein the method comprises:

supplying, via the control circuitry, a constant average power to the heating element in response to a signal output from the user activation mechanism, wherein the control circuitry is configured to supply the constant average power to the heating element regardless of the temperature of the heating element;

wherein the constant average power is set such that the rise in temperature after the onset of dryout, from an operational temperature at which vapor is generated, does not exceed 90° C. per second; and wherein the constant average power is set such that the rise in temperature after the onset of dryout, from an operational temperature at which vapor is generated, does not fall below 10° C. per second, such that the rise in temperature after the onset of dryout provides a gradually detectable taste to a user to act as an indicator to prompt the user to undertake an action corresponding to depletion of the wick of liquid vapor precursor material.

13. A vapor provision system comprising:

a heating means for generating vapor from a liquid vapor precursor material;

a wicking means for transporting liquid vapor precursor material from a storage means to the heating means;

a user activation means for signaling the user's intent to start vapor generation and configured to be actuated by a user; and control means configured to supply a constant average power to the heating means in response to a signal output from the user activation means, wherein the control means is configured to supply the constant average power to the heating means regardless of the temperature of the heating means;

wherein the constant average power is set such that the rise in temperature after the onset of dryout, from an operational temperature at which vapor is generated, does not exceed 90° C. per second; and wherein the constant average power is set such that the rise in temperature after the onset of dryout, from an operational temperature at which vapor is generated, does not fall below 10° C. per second, such that the rise in temperature after the onset of dryout provides a gradually detectable taste to a user to act as an indicator to prompt the user to undertake an action corresponding to depletion of the wick of liquid vapor precursor material.

* * * * *